United States Patent [19]

Alexander, Sr.

[11] Patent Number: 4,803,812

[45] Date of Patent: Feb. 14, 1989

[54] POST GROUND ANCHOR AND METHOD

[75] Inventor: Walter A. Alexander, Sr., Marietta, Ga.

[73] Assignee: VSAR Systems of Atlanta, Inc., Marietta, Ga.

[21] Appl. No.: 123,709

[22] Filed: Nov. 23, 1987

[51] Int. Cl.[4] ..... E02D 5/80

[52] U.S. Cl. ..... 52/157

[58] Field of Search ..... 52/156, 157

[56] References Cited

U.S. PATENT DOCUMENTS

| | | | |
|---|---|---|---|
| 775,759 | 11/1904 | Meinecke | 52/156 |
| 903,944 | 11/1908 | Andersen | 52/156 |
| 911,504 | 2/1909 | Jay | 52/156 |
| 3,969,853 | 7/1976 | Dieke | 52/156 |
| 4,280,768 | 7/1981 | Pardue et al. | 403/3 |
| 4,389,034 | 6/1983 | Suttles | 248/49 |
| 4,492,493 | 1/1985 | Webb | 52/157 |
| 4,593,872 | 6/1986 | Svensson | 248/156 |
| 4,653,245 | 3/1987 | Webb | 52/749 |

*Primary Examiner*—J. Karl Bell

*Attorney, Agent, or Firm*—Thomas & Kennedy

[57] ABSTRACT

A ground anchor has a spike with bit mounted coaxially to a prop of greater width than the spike. A structurally independent platform is provided to be placed about the spike and butted against the prop as the spike is rotatably driven into the ground.

13 Claims, 2 Drawing Sheets

POST GROUND ANCHOR AND METHOD

TECHNICAL FIELD

This invention relates to ground anchors for use in anchoring posts, poles and the like uprightly upon the ground, and to methods of performing such operations.

BACKGROUND OF THE INVENTION

Ground or earth anchors have heretofore been devised for use in anchoring structures firmly to the ground. Exemplary of such are those shown in U.S. Pat. Nos. 3,969,853, 4,280,768, 4,593,872 and 4,653,245. Some ground anchors are designed to be manually embedded into the soil while others are designed to be mechanically embedded by the use of power tools known as anchor drivers. The present invention is directed to a ground or earth anchor of the latter type for the support of posts uprightly upon the surface of the ground.

As shown in the just mentioned patents, those ground anchors that are used to support large structures have themselves had to be of relatively large, complex and rugqedized construction in order to accommodate the large forces necessary to embed the anchors deeply and to provide sufficient anchoring power once embedded. Conversely, ground anchors that have been devised for supporting smaller structures such as fence posts, guard rails, tent posts and the like have been relatively simple, lightweight and usually designed for manual installation. Heretofore, it has generally been thought that ground anchors for posts have had to be of the manual embedding type to render them economically feasible.

The present invention has for a principal object the provision of a ground anchor for use in supporting posts uprightly upon the surface of the ground which is of relatively simple and economic construction and yet which is adapted to be readily installed with the use of power tools. With its use the labor involved in digging post holes or in manually embedding an anchor may be reduced or even eliminated. Its use also eliminates the need for the use of concrete in forming an in situ anchor about the post and thus also serves to eliminate the waiting period for concrete to set in order to complete installation.

SUMMARY OF THE INVENTION

In one form of the invention a ground anchor for anchoring a post comprises an elongated prop adapted to be driven by rotary drive means and to which an end of a post to be supported may be telescopically mounted for vertical support. A spike extends from an end of the prop that bears a shoulder of a width greater than the width of the spike. A bit is mounted adjacent an end of the spike located distally from the prop. A platform is provided which is configured to be mounted about the spike in abutment with the post shoulder.

In another form of the invention a ground anchor for anchoring a post comprises a cylindrical prop to which a bottom end portion of a post may be telescopically mounted. A cylindrical spike is mounted coaxially to an end of the cylindrical prop with the spike having a diameter less than the diameter of the prop whereby a radial step is formed adjacent the junction of the prop and spike. A platform is also provided which is adapted to be mounted about the spike beneath the step. A bit is mounted to an end of the spike located distally from the step.

In yet another form of the invention a method of anchoring a post uprightly upon the ground comprises the step of driving an anchor partially into the ground of a type that has a relatively thin lower portion adapted to be embedded and a relatively thick upper portion adapted to be telescopically mounted to a bottom of the post. A stabilizing platform is placed about the anchor lower portion adjacent its junction with the anchor upper portion. The anchor is then driven further into the ground so as to cause the platform to become sandwiched snuggly and securely between a lower end of the anchor upper end portion and the surface of the ground. The post is then mounted upon the anchor and platform.

DETAILED DESCRIPTION

Figure 1:
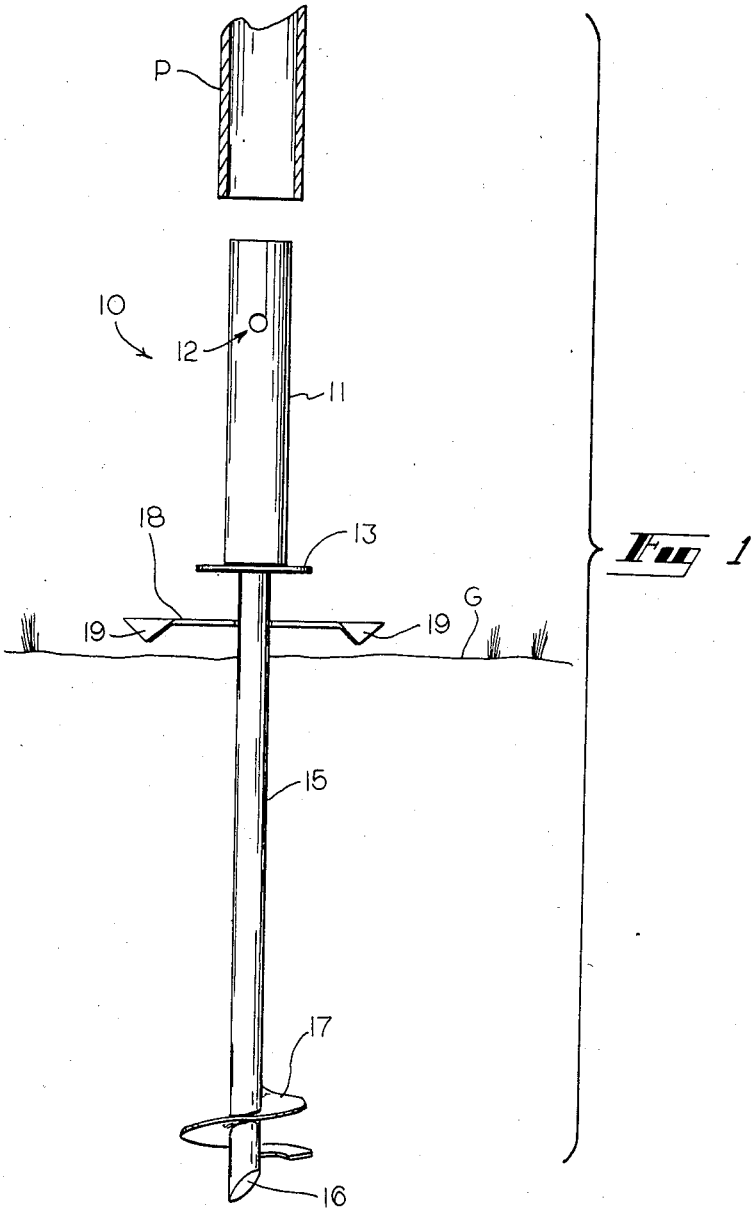
FIG. 1 is a side elevational view of a ground anchor embodying principles of the invention.
Figure 2:
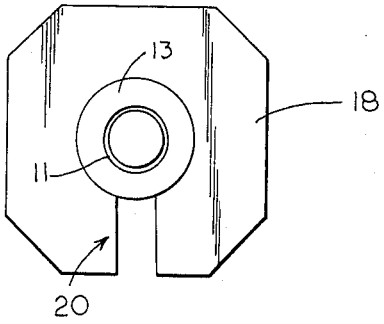
FIG. 2 is a plan view of the ground anchor illustrated in FIG. 1 shown together with a post or pole mounted thereon.

With reference next to FIGS. 1 and 2, there is shown a ground or earth anchor 10 which has a cylindrical, tubular support or prop 11 provided with a hole 12 in a side thereof to receive the pin of a conventional motorized anchor driver. A disc-shaped plate 13 is welded coaxially to the bottom of the tubular prop 11. A cylindrical spike 15 is in turn welded to the other side of the plate 13 so as to extend coaxially from the prop 11. The end of the spike located distally from the prop is formed with a beveled tip 16. A helical bit or auger fluke 17 is mounted to the spike adjacent the tip 16.

The ground anchor also includes a structurally independent platform 18 which, as can best be seen from FIG. 2, is in the form of a square plate. Each of the four corners of the plate are downturned to form four spade-like prongs 19. The plate is also formed with a slot 20 which extends from one of its sides to and somewhat past the plate center. This slot is sized to receive the spike 15 so that it may be placed about it.

A hollow post or pole P may be mounted uprightly upon the surface of the ground G by means of the just described anchor in the following manner. In this case the post is of a tubular configuration, such as a conventional tennis fence post. The anchor tip is first forced into the ground with the anchor oriented uprightly so as to bring the bit into contact with the surface. An anchor driver is then coupled with the prop 11 by inserting its rotatable drive arm into the upper end of the prop and extending its locking pin laterally through the hole 12 to secure it to the prop. The anchor driver is then operated which causes the anchor to rotate. With some downward pressure applied, as by the weight of the driver, the helical bit 17 forces the spike 15 down into the ground as the prop and spike are rotated. This action is continued until the spike has been driven into the ground approximately to the position shown in FIG. 1.

Next the platform 18 is placed about the spike, as shown in FIG. 1, with its prongs 19 in contact with the ground. The anchor driver is further operated which causes the spike and prop to be driven further downwardly bringing the plate 13, which forms a step or shoulder at the junction of the prop and spike, into contact with the top of the platform 18. Further operation of the anchor driver causes the ground anchor to be driven still further downward thereby causing the prongs 19 of the platform , which is not being rotated, to become embedded in the surface of the ground and to bring the remainder of the platform into flush engagement with the surface of the ground G. The anchor driver is then uncoupled and removed from the prop 11 leaving the anchor firmly embedded in the ground with its prop projecting upwardly therefrom and with the platform providing a high degree of stability positioned flushly atop the ground. The tubular fence post P is then telescoped upon the prop and brought to rest upon plate 13 with its inside positioned closely about the prop.

Figure 3:
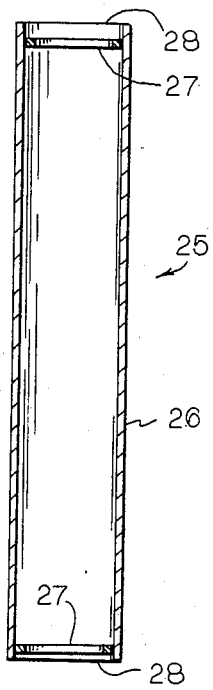
FIG. 3 is a cross-sectional view of an adapter for use with the ground anchor illustrated in FIG. 1.

A ground anchor of the same size as that just described may also be used to support a larger post or pole than post P by the use of the adapter shown in FIG. 3. The adapter 25 here is comprised of a cylindrical tube or pipe 26 which has a pair of rings 27 welded to its interior adjacent its ends 28. So constructed, the adapter 25 may be slid upon the prop 11 after the ground anchor has been embedded. A larger pipe may then be telescoped over the adapter to provide a close fit for stable ground support.

Figure 4:
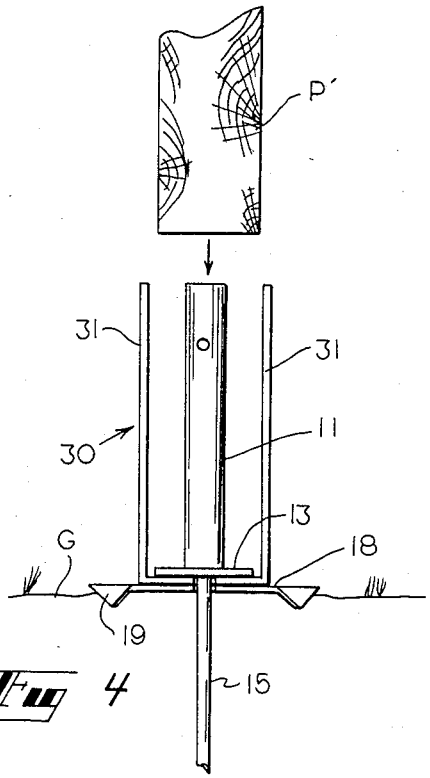
FIG. 4 is a side elevational view of the ground anchor illustrated in FIG. 1 together with another adapter thereto.
Figure 5:
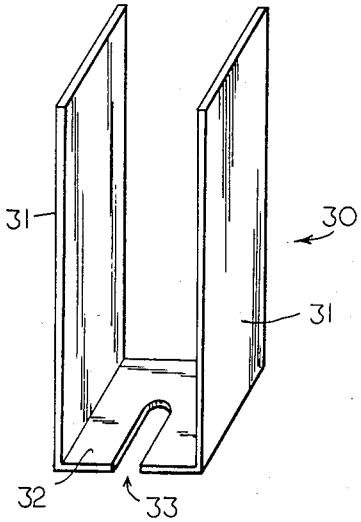
FIG. 5 is a perspective view of the adapter shown in FIG. 4.

The ground anchor illustrated in FIG. 1 may also be used to support square shaped rather than cylindrically shaped posts by the use of the other adapter 30 illustrated in FIGS. 4 and 5. This adapter is of U-shaped construction formed from a strip of metal that is bent into this shape to form two parallel leg portions 31 joined by a bight portion 32. The bight portion is formed with a slot 33 which is sized to receive the spike 15. In use, the adapter 30 is placed upon the platform 18 beneath the plate 13 just before the platform is finally driven into place upon the surface of the ground G, as shown in FIG. 4. With a channel having been drilled into the bottom of a wooden post P', the post is telescoped upon the prop 11 between the legs 31 of the adapter 30 thereby becoming mounted uprightly and secured upon the ground anchor and the ground.

It thus is seen that a ground anchor of very simple and economic construction is provided which may be readily embedded in the ground for use. Though the posts or poles illustrated in the drawing have been telescoped about the anchor prop, it should be understood that the telescopic arrangement may be reversed with the posts being mounted inside of the prop. Though the prop has been shown to be cylindrical here, such is not essential. Nor is the use of the plate 13 since the bottom of the prop itself may provide a step or shoulder for the platform to abut. Thus, the plate essentially serves to widen the shoulder for enhanced stability and to facilitate welding of the spike to the prop during anchor manufacture. Though steel is preferred as the material for all of the anchor components, other metals could be used instead. And though the anchor is designed to be driven with a powered driver, it could be manually driven.

Thus, it should be understood that many modifications, additions and deletions may be made to the specific embodiments illustrated, other than those just expressly suggested, without departure from the spirit and scope of the invention as set forth in the following claims.

I claim:

1. A ground anchor for anchoring a post comprising an elongated prop adapted to be driven by rotary drive means and to which an end of the post may be telescopically mounted, a spike rigidly mounted to and extending from an end of said prop that bears a shoulder of a width greater than the width of said spike, a bit mounted adjacent an end of said spike located distally from said prop, and a platform configured to be mounted about said spike in abutment with said post shoulder.

2. The ground anchor of claim 1 wherein said prop is substantially cylindrical.

3. The ground anchor of claim 2 wherein said shoulder comprises a flat plate rigidly mounted flush to an end of said cylindrical prop.

4. The ground anchor of claim 2 further comprising an adapter for use in anchoring a generally U-shaped post having two parallel flat sections joined at one end by a flat bight section that has a slot sized to receive said spike.

5. The ground anchor of claim 2 further comprising an adapter for use in anchoring a hollow cylindrical post having an inside diameter substantially greater than the outside diameter of said prop to said anchor, said adapter comprising a tube having a ring mounted within each end thereof, the inside diameter of each ring substantially matching the outside diameter of said cylindrical prop.

6. The ground anchor of claim 2 further comprising an adapter for use in anchoring a square-shaped post to said anchor, said adapter comprising a generally U-shaped plate having two parallel legs that extend from a bight and with said bight having a slot sized to receive said spike.

7. The ground anchor of claim 1 wherein said platform comprises a plate having a slot extending from a side thereof of a size to receive said spike.

8. The ground anchor of claim 7 wherein said platform has downturned corners that provide prongs adapted to be embedded into the ground.

9. The ground anchor of claim 1 wherein said bit is comprised of a helical plate.

10. A ground anchor for anchoring a post comprising a substantially cylindrical prop to which a bottom end portion of a post may be telescopically mounted, a substantially cylindrical spike rigidly mounted coaxially to an end of said cylindrical prop, said spike having a diameter less than the diameter of said prop whereby a step is formed adjacent the junction of said prop and said spike, a platform adapted to be mounted about said spike beneath said step, and a bit mounted to an end of said spike located distally from said step.

11. The ground anchor of claim 10 wherein said platform is comprised of a plate having downturned corners adapted to be staked into the ground.

12. A method of anchoring a post uprightly upon the ground comprising the steps of:

(a) driving an elongated anchor partially into the ground of the type that has a relatively thin lower portion adapted to be embedded and a relatively thick upper portion adapted to be telescopically mounted to a bottom portion of the post, (b) placing a stabilizing platform of the type having downturned prongs about the anchor lower portion adjacent the anchor upper portion, (c) driving the anchor further into the ground so as to bring the platform against a lower end of the anchor upper portion and the surface of the ground, and (d) mounting the post upon the anchor upper portion.

13. The anchoring method of claim 12 wherein steps (a) and (c) the spike is rotatably driven.

* * * * *